US005462842A

United States Patent [19]

Romano, Jr. et al.

[11] Patent Number: 5,462,842

[45] Date of Patent: Oct. 31, 1995

[54] PHOTOGRAPHIC ELEMENT HAVING A BLUE LIGHT SENSITIVE LAYER CONTAINING A PARTICULAR YELLOW DYE-FORMING COUPLER AND A MAGENTA IMAGE DYE-FORMING COUPLER

[75] Inventors: Charles E. Romano, Jr.; Larry D. Edwards; Richard E. Hibbs, all of Rochester, N.Y.

[73] Assignee: Eastman Kodak Company, Rochester, N.Y.

[21] Appl. No.: 180,252

[22] Filed: Jan. 12, 1994

[51] Int. Cl.[6] ..... G03C 1/46

[52] U.S. Cl. ..... 430/503; 430/506; 430/549; 430/554; 430/555; 430/557; 430/558

[58] Field of Search ..... 430/503, 506, 430/557, 558, 555, 554, 549

[56] References Cited

U.S. PATENT DOCUMENTS

| | | | |
|---|---|---|---|
| 4,273,861 | 6/1983 | Shiba et al. | 430/382 |
| 4,614,709 | 9/1986 | Sasaki et al. | 430/557 |
| 5,066,574 | 11/1991 | Kubota et al. | 430/537 |
| 5,215,877 | 6/1993 | Tomotake et al. | 430/557 |

FOREIGN PATENT DOCUMENTS 05072690 3/1993 Japan .

*Primary Examiner*—Charles L. Bowers, Jr.
*Assistant Examiner*—Geraldine Letscher
*Attorney, Agent, or Firm*—Arthur E. Kluegel

[57] ABSTRACT

The invention provides a photographic element and process of forming an image where the element is a multicolor photographic element comprising at least one light sensitive photographic silver halide emulsion layer sensitive to blue light and containing a yellow image dye-forming coupler, at least one light sensitive photographic silver halide emulsion layer sensitive to green light: and containing a magenta image dye-forming coupler, and at least one light sensitive photographic silver halide emulsion layer sensitive to red light and containing a cyan dye-forming coupler, wherein the yellow image dye-forming coupler has the formula I:

I wherein t-Bu is a tertiary butyl group, Ph is an unsubstituted phenyl ring or one containing up to 5 substituents, and Y is a heterocyclic ring, substituted or non, which is capable of leaving upon reaction if the coupler with oxidized developer; and wherein said at least one light sensitive photographic silver halide emulsion layer sensitive to blue light and containing the yellow image dye-forming coupler, or another light sensitive photographic silver halide emulsion layer sensitive to blue light and containing a yellow image dye-forming coupler has associated therewith a magenta image dye-forming coupler.

20 Claims, No Drawings

PHOTOGRAPHIC ELEMENT HAVING A BLUE LIGHT SENSITIVE LAYER CONTAINING A PARTICULAR YELLOW DYE-FORMING COUPLER AND A MAGENTA IMAGE DYE-FORMING COUPLER

FIELD OF THE INVENTION

This invention relates to a multicolor photographic element and a method of forming an image therewith wherein the element has a blue light sensitive layer containing a yellow image dye-forming coupler which is a t-butylacylacetanilide having a heterocyclic coupling-off group, said layer having associated therewith a magenta image dye-forming coupler.

BACKGROUND OF THE INVENTION

Multicolor photographic elements containing various yellow image dye-forming couplers in a blue light sensitive layer are known. Typically, such couplers are based on open chain keto-methylene compounds, usually either alkyl- or aryl-acyl acetanilides. Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). These known couplers include those employing a heterocyclic coupling-off group such as one based on a hydantoin moiety.

Yellow image dye-forming couplers have been used with various groups bonded at the coupling site. The portion of the coupler which couples with oxidized developer is usually referred to as the "parent" or "Coup" group. The term "image dye-forming" coupler generally means a coupler that has as its principal function the function of providing image dye density. Such couplers may be distinguished, for example, from masking couplers which have as a primary purpose masking unwanted absorptions through providing one color in exposed areas and another color in unexposed areas and may be distinguished from "PUG" releasing couplers which have the primary function of releasing PUGs (Photographically Useful Groups) which improve sharpness etc.

For image dye-forming couplers, the parent or Coup group may be bonded at the coupling site to hydrogen or, more commonly, to a "coupling-off" (COG) or "leaving" group. The use of leaving groups rather than hydrogen is generally preferred for various reasons, foremost of which is that they provide more efficient dye formation relative to silver development. Coupling-off groups of the art generally include a wide variety of chemical groups including both aryloxy and heterocyclic groups, and these are discussed in more detail in the patents identified in the first paragraph of this section. None of these coupling-off groups have been altogether satisfactory.

Yellow dye-forming couplers containing an aryloxy coupling-off group have been deficient in photographic properties, particularly from the standpoint of raw stock keeping. It has been observed that the presence of such couplers containing an aryloxy coupling-off group fosters degradation of the film upon storage prior to exposure. This results in loss of image dye density and the formation of undesirable by-products as a function of time. Since it is desired that an identical image of an object be obtained regardless of raw stock storage time, this degradation needs to be minimized.

On the other hand, the use of heterocyclic coupling-off groups has lead to color reproduction problems. The hue of a dye produced by an image dye-forming coupler is dependent on the formula of the parent portion of the parent/coupling-off group compound and on the identity of the coupling-off group. The coupling-off group, once replaced by oxidized developer, remains in the vicinity of the reaction and influences the hue of the dye formed. In the particular case of heterocyclic coupling-off groups, the hue of orange and blue objects has proven to often be unsatisfactory when these types of couplers are employed.

U.S. Pat. No. 4,273,861 suggests the use of interlayer color correction couplers to improve color reproduction. Various suggestions are made for the inclusion of development inhibitor releasing couplers in particular layers to improve color reproduction. No suggestion is made of the hue problem occasioned by the use of t-butylacylacetanilide yellow couplers having a heterocyclic coupling-off group in the blue sensitive layer nor is there any suggestion to include a magenta image dye-forming coupler in a blue sensitive layer.

According to the abstract of Japanese published patent application 05/072,690, it has been suggested to employ magenta or cyan couplers in the blue sensitive layer of a photographic element in combination with one of three yellow dye-forming couplers which are either diamides or which have a ring adjacent the acyl carbon for the purpose of improved dye stability and increased maximum dye density. The abstract does not suggest photographic elements having a blue sensitive layer containing a t-butylacylacetanilide yellow image dye-forming coupler nor does it suggest that improved raw stock keeping and color reproduction are obtainable.

There is therefore a need for a photographic element which provides the combination of good raw stock keeping characteristics while also providing good color reproduction.

SUMMARY OF THE INVENTION

The invention provides a photographic element and process of forming an image where the element is a multicolor photographic element comprising at least one light sensitive photographic silver halide emulsion layer sensitive to blue light and containing a yellow image dye-forming coupler, at least one light sensitive photographic silver halide emulsion layer sensitive to green light and containing a magenta image dye-forming coupler, and at least one light sensitive photographic silver halide emulsion layer sensitive to red light and containing a cyan dye-forming coupler, wherein the yellow image dye-forming coupler has the formula I:

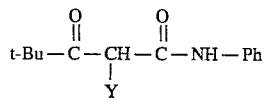

I wherein t-Bu is a tertiary butyl group, Ph is an unsubstituted phenyl ring or one containing up to 5 substituents, and Y is a heterocyclic ring, substituted or not, which is capable of leaving upon reaction of the coupler with oxidized developer; and wherein said at least one light sensitive photographic silver halide emulsion layer sensitive to blue light and containing the yellow image dye-forming coupler, or another light sensitive photographic silver halide emulsion layer sensitive to blue light and containing a yellow image dye-forming coupler, has associated therewith a magenta image dye-forming coupler.

The photographic element of the invention provides improved photographic properties such as raw stock keeping characteristics while also providing good color reproduction compared to elements heretofore known.

DETAILED DESCRIPTION OF THE INVENTION

The yellow image dye-forming coupler which is the subject of the invention has the formula I:

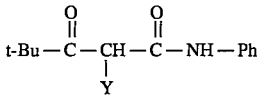

I wherein t-Bu is a tertiary butyl group, Ph is an unsubstituted phenyl ring or one containing up to 5 substituents, and Y is a heterocyclic ring, substituted or not, which is capable of leaving upon reaction of the coupler with oxidized developer. In a more specific embodiment, such a coupler is represented by the formula:

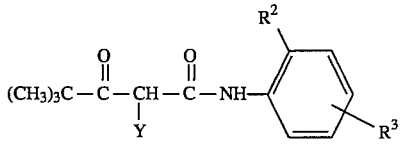

wherein $R^2$ is chlorine, bromine or alkoxy group;

$R^3$ is a ballast group, such as $—SO_2R$; $—SO_2NHR$; $—OSO_2R$; $—CO_2R$; $—CO_2NHR$; —NHCOR; and $—NHSO_2R$; and Y is a substituted or unsubstituted heterocyclic coupling-off group.

Suitably, Y is represented by the formula:

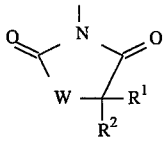

wherein W is selected from the group consisting of —O—, —S—, $—N(R^3)—$, and $—C(R^4)(R^5)—$; $R^1$ is H, or substituted or unsubstituted alkyl, alkoxy, phenyl, or phenoxy; $R^2$ and $R^5$ are independently H or substituted or unsubstituted alkyl; $R^3$ is substituted or unsubstituted alkyl or phenyl; and $R^4$ is H or substituted or unsubstituted alkyl or alkoxy. In one embodiment, W is $—NR^3$; $R^1$ is H, or substituted or unsubstituted alkyl or alkoxy; $R^2$ is H; and $R^3$ is substituted or unsubstituted alkyl. In another embodiment W is $—C(R^4)(R^5)$, $R^1$ is $—OC_2H_5$, $R^2$ is H and $R^3$ is $—CH_2$-phenyl.

Typically, Y is selected from the group consisting of substituted and unsubstituted hydantoin, succinimide, imidazole and pyrazole groups. Examples of suitable Y groups are:

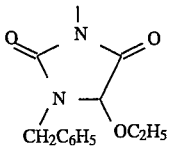

IIa

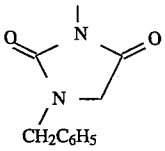

IIb

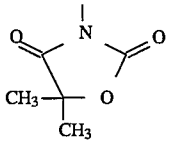

IIc

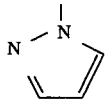

IId

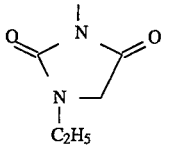

IIe

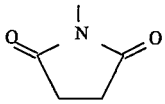

IIf

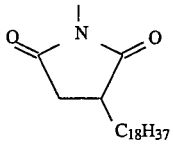

IIg

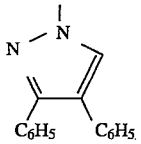

IIh

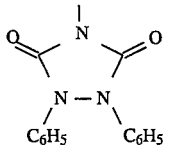

IIi

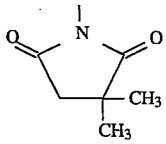

IIj

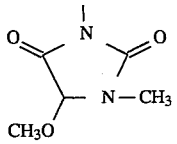

IIk

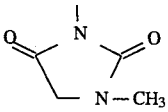

III and

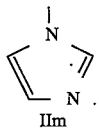

IIm

Examples of suitable yellow image dye-forming couplers of formula ( I ) are as follows:

IA

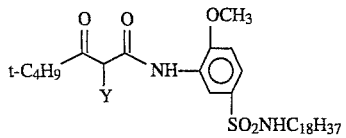

IB

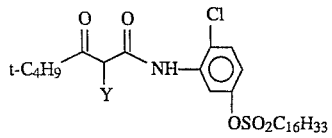

IC

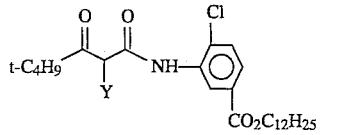

ID

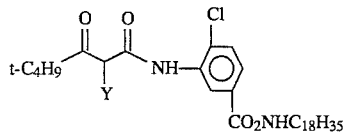

IE

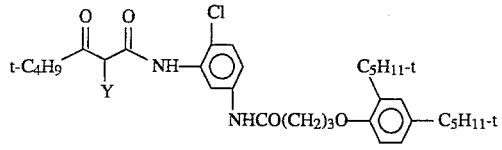

IF

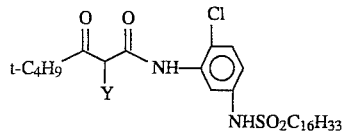

IG

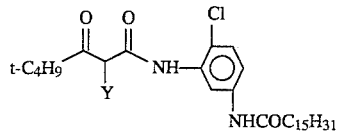

where Y is a coupling-off group as defined earlier.

The magenta image dye-forming coupler of the invention may be any magenta coupler known in the art such as the following:

Compound I-1

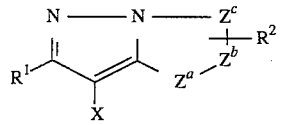

and

Compound I-2

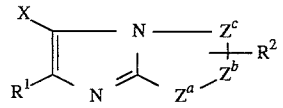

wherein $R^1$ and each $R^2$ are independently hydrogen or substituents that do not adversely affect the coupling action of the coupler; X is hydrogen; and $Z^a$, $Z^b$ and $Z^c$ are independently selected from the group consisting of a substituted or unsubstituted methine group, =N—, =C— or —NH—, provided that one of either the $Z^a$–$Z^b$ bond or the $Z^b$–$Z^c$ bond is a double bond and the other is a single bond, and when the $Z^b$–$Z^c$ bond is a carbon-carbon double bond, it may form part of an aromatic ring, and wherein at least one of $Z^a$, $Z^b$ and $Z^c$ represents a methine group connected with the group $R^2$;

Specific examples of suitable magenta couplers meeting the foregoing definition are:

I-3

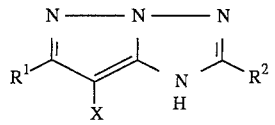

I-4

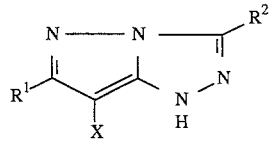

I-5

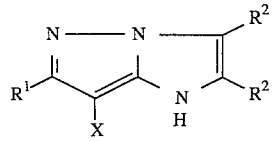

I-6

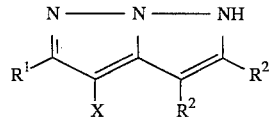

I-7

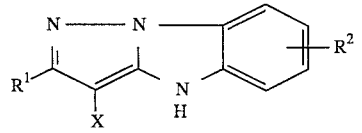

I-8

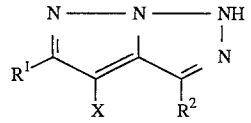

I-9

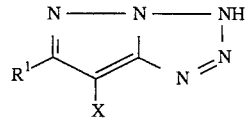

and

I-10

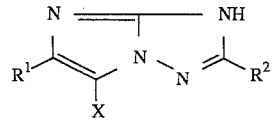

Other suitable magenta couplers may be selected from compounds having formulas I-11 through I-16:

I-11

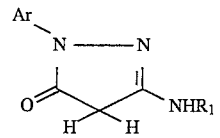

wherein:

Ar is an unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R_1$ is a substituted or unsubstituted acyl or phenyl group, the substituents of $R_1$ being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R_1$ contains at least 6 carbon atoms or the $R_1$ substituents may individually comprise a group which forms a link to a polymeric chain;

Specific examples of suitable magenta image dye-forming couplers are:

M-1

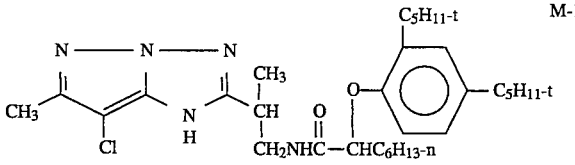

M-2

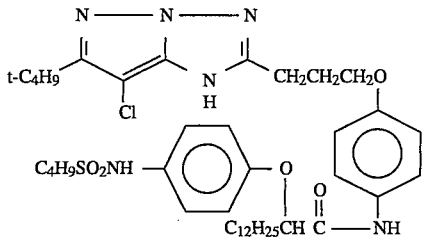

M-3

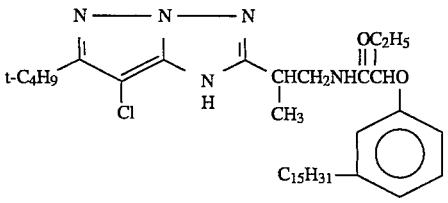

M-4

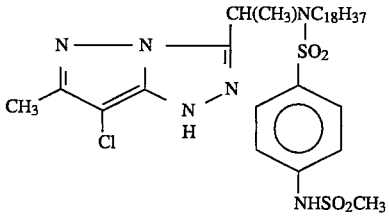

M-5

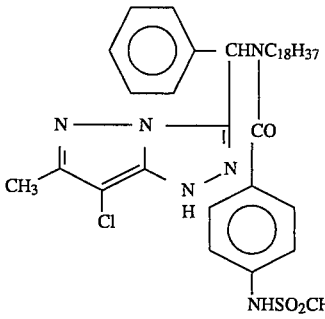

M-6

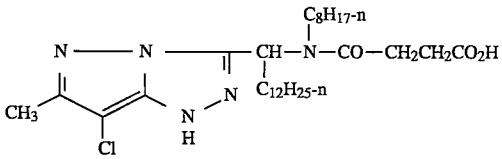

M-7

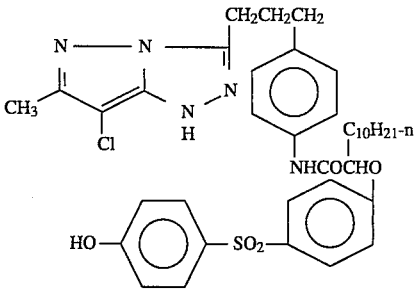

M-8

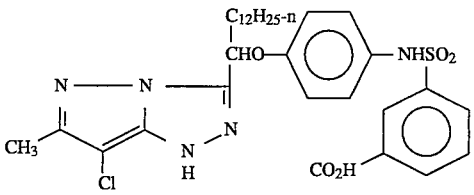

M-9

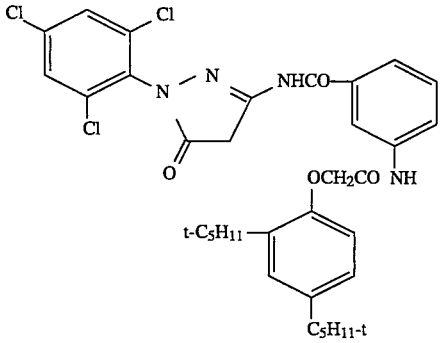

-continued

M-10

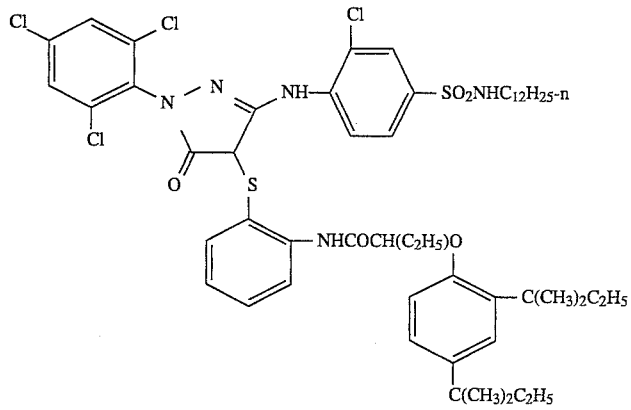

M-11

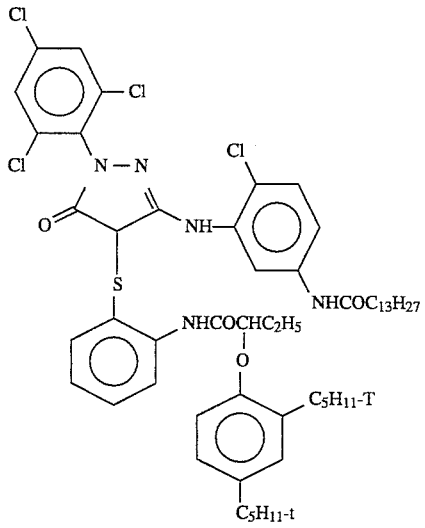

M-12

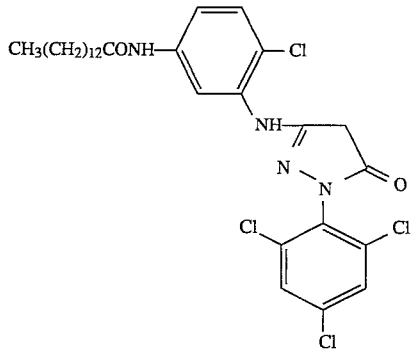

It should be noted that the photographic elements of the invention may employ yellow image dye-forming couplers of more than one type. Thus, for example, those within the scope of the invention may be employed in the same or a different layer from those outside the invention ( e.g. those having a different parent (e.g. a benzoylacetanilide) or coupling-off group (e.g. a phenoxy group.) Thus, it may be desirable to provide an element containing some yellow image dye-forming coupler containing a phenoxy coupling-off group for reactivity purposes while at the same time including yellow image dye-forming coupler in accordance with the invention in order to improve photographic properties such as dye stability and raw stock keeping.

As used herein, the term "substituted" or "substituent", unless otherwise specifically stated, has a broad definition. The substituent may be, for example, halogen, such as chlorine, bromine or fluorine; nitro; hydroxyl; cyano; and carboxy and its salts; and groups which may be further substituted, such as alkyl, including straight, branched chain and cyclic alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, a- or b-naphthyloxy, and 4-tolyloxy; carbonamido, such as acetamido, benzamido, butyramido, tetradecanamido, a-(2,4-di-t-pentylphenoxy) acetamido, a-(2,4-di-t-pentylphenoxy)butyramido, a-(3-pentadecylphenoxy)hexanamido, a-(4-hydroxy-3-t-butylphenoxy)tetradecanamido, 2-oxo-pyrrolidin-1-yl, 2-oxo-5-tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylcarbonylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N, N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, and hexadecylsulfonamido; sulfamoyl, such as N-methylsulfamoyl, N,N-dipropylsulfamoylamino, N-ethylsulfamoyl, N,N-dipropylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy) acetyl, phenoxycarbonyl, p-dodecyloxyphenoxycarbonyl methoxycarbonyl, butoxy-carbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-toctylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic or other properties for a specific application and can include, for example, hydrophobic groups, solubilizing groups, blocking groups, etc. Generally, all of the "R" groups herein and substituents thereof may typically include those having 1 to 42 carbon atoms and often less than 30 carbon atoms, but greater numbers are possible depending on the particular substituents selected. Moreover, as indicated, the substituents may themselves be suitably substituted with any of the above groups.

In one embodiment of the invention, a photographic element comprises the following layer order:

| Layer | Identification |
|---|---|
| 15 | OVERCOAT |
| 14 | UV |
| 13 | LEAST BLUE SENSITIVE OR SLOW YELLOW |
| 12 | MOST BLUE SENSITIVE OR FAST YELLOW |
| 11 | INTERLAYER |
| 10 | MOST GREEN SENSITIVE OR FAST MAGENTA |
| 9 | INTERLAYER |
| 8 | MOST RED SENSITIVE OR FAST CYAN |
| 7 | MID RED SENSITIVE OR MID CYAN |
| 6 | INTERLAYER |
| 5 | LEAST GREEN SENSITIVE OR SLOW MAGENTA |
| 4 | INTERLAYER |
| 3 | LEAST RED SENSITIVE OR SLOW CYAN |
| 2 | INTERLAYER |
| 1 | ANTIHALATION LAYER |
| | SUPPORT |

In the following discussion, references are to formula numbers which are cataloged at the end of the examples.

The image dye-forming couplers in the blue-sensitive, green-sensitive and red sensitive layers as described may include any of the image dye-forming couplers known in the photographic art for such layers for forming yellow, magenta and cyan dye images as more fully described herein. Combinations of image dye-forming couplers can be useful in the described photographic silver halide emulsion layers.

Image dye-forming couplers in accordance with the invention are those which function primarily to couple with oxidized developer to form a dye where an image is present. Except for the particular yellow image dye-forming coupler of the invention containing a heterocyclic coupling-off group, they may be 4-equivalent or 2-equivalent. In 4-equivalent couplers, there is no coupling-off group and the oxidized developer couples with the coupler by replacement of a hydrogen. In 2-equivalent couplers, there is a releasable substituent other than hydrogen at the coupling position of the coupler parent (COUP.) While this substituent or coupling-off group (COG) in an "image dye-forming" coupler may be selected so as to affect dye formation characteristics and/or dye properties, it is not a dye or other photographically useful group (PUG.).

As used in the present invention, when layers are said to have the same or substantially the same spectral senitivity, it is meant that they are sensitized within the same spectral range e.g. red, green or blue.

A photographic element in accordance with the invention might have the following configuration:

OVERCOAT LAYER

The overcoat layer can combine a single or double layer. This layer can contain components known in the photographic art for overcoat layers and can contain UV absorbers, matting agents, surfactants, and like. This layer, for example, can also comprise a dye which can help in adjusting the photographic sensitivity of the element. If desired, a separate layer can be employed to absorb ultroviolet rays.

SLOW YELLOW LAYER

In the photographic element, the least sensitive blue or slow yellow layer may contain a yellow image dye-forming coupler and a bleach accelerator releasing coupler. In accordance with the invention, either this or the fast yellow layer has associated therewith a magenta image dye-forming coupler. As used herein, the term "associated" signifies that the compound is in the silver halide emulsion layer or in an adjacent layer where, during processing, it is capable of reacting with silver halide development products.

The yellow image dye-forming coupler can be any yellow image dye-forming coupler useful in the photographic art. Such couplers include:

the class of yellow image dye-forming couplers characterized as benzoylacetanilide couplers as illustrated by those described in, for example U.S. Pat. Nos. 4,022,620 and 4,980,267, the disclosure of which is incorporated herein by reference. A typical example of such a coupler is illustrated by the Formula (8). (See table of formulas following Example 1.)

the class of yellow image dye-forming couplers characterized as alkylacylacetanilide couplers as illustrated by those described in, for example U.S. Pat. No. 3,933,501 that comprise a phenoxy coupling off group, the disclosure of which is incorporated herein by reference. Such a coupler is represented by the formula:

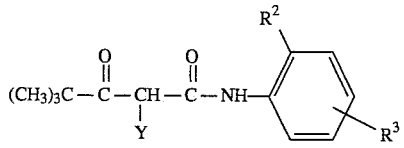

wherein $R^2$ is chlorine, bromine or alkoxy;

$R^3$ is a ballast group, and

Y is a nonheterocyclic coupling-off group, such as a substituted or unsubstituted phenoxy group.

One suitable yellow image dye-forming coupler is as shown in formula (24).

The bleach accelerator releasing coupler (BARC) can be any bleach accelerator releasing coupler know in the photographic art. Combinations of such couplers are also useful. The bleach accelerator releasing coupler can be represented by the formula:

$$COUP + T^2 \frac{1}{m} S - R^3 - R^4$$

wherein

COUP is a coupler moiety as described, typically a cyan, magenta or yellow dye-forming coupler moiety;

$T^2$ is a timing group known in the photographic art, typically a timing group as described in U.S. Pat. Nos. 4,248,962 and 4,409,323, the disclosures of which are incorporated herein by reference;

m is either 0 or 1;

$R^3$ is an alkylene group, especially a branched or straight chain alkylene group, containing 1 to 8 carbon atoms; and $R^4$ is a water-solubilizing group, preferably a carboxy group.

Typical bleach accelerator releasing couplers are described in, for example, European Patent 193,389, the disclosure of which is incorporated herein by reference.

A preferred bleach accelerator releasing coupler is represented by formula (7).

FAST YELLOW LAYER

In the photographic element, the most sensitive blue or fast yellow layer may contain a yellow image dye-forming coupler, a development inhibitor releasing coupler (DIR), and/or a timed development inhibitor releasing coupler (DIAR) and a bleach accelerator releasing coupler. In accordance with the invention, either one of the yellow dye-forming layers or an associated layer adjacent thereto contains a magenta image dye-forming coupler. Suitably, the fast yellow layer may contain such a magenta coupler.

The yellow image dye-forming coupler can be any yellow image dye-forming coupler useful in the photographic art. Suitable yellow image dye-forming couplers useful in the invention are as earlier described with respect to the slow yellow layer, with the preferred coupler illustrated by the formula (16).

The development inhibitor releasing coupler in the fast yellow layer can be any DIR known in the photographic art. Typical DIR couplers are described in, for example, U.K. Patent 2,099,167, the disclosure of which is incorporated herein by reference. Such DIR couplers upon oxidative coupling preferably do not contain a group that times or delays release of the development inhibitor group. The DIR coupler is typically represented by the formula:

$$COUP—INH$$

wherein:

COUP is a coupler moiety, and

INH is a releasable development inhibitor group that is bonded to the coupler moiety at a coupling position. The coupler moiety, COUP, can be any coupler moiety that is capable of releasing the INH group upon oxidative coupling as more fully described hereafter and may include, for example, the coupler shown as formula (21).

The DIAR which can be used can be any DIAR which will provide a timed development inhibitor release as more fully described hereinafter. The development inhibitor releasing coupler containing at least one timing group is represented by the formula:

$$COUP - T + T^1 \frac{1}{n} Q^1$$

wherein:

COUP is a coupler moiety, as described, typically a cyan, magenta, or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1;

$Q^1$ is a releasable development inhibitor group known in the photographic art. $Q^1$ can be selected from the INH group as described.

A preferred coupler of this type is described in U.S. Pat. No. 4,962,018, the disclosure of which is incorporated herein by reference.

The timed DIR coupler is typically a pivalylacetanilide coupler, with a preferred timed DIR coupler illustrated by formula (18).

Suitable bleach accelerator releasing couplers useful in the invention are as described for the slow yellow layer with the preferred compound being the same as described with respect to such slow yellow layer.

The magenta image dye-forming coupler can be any such coupler useful in the photographic art as described earlier.

INTERLAYER

In the photographic element the interlayer between the fast yellow layer and the fast magenta layer may contain Carey Lea silver (CLS) and any oxidized developer scavenger known to the photographic art. Such oxidized developer scavengers are described in U.S. Pat. No. 4,923,787, the disclosure of which is incorporated herein by reference.

A preferred oxidized developer scavenger is represented by formula (2). This layer may also contain dyes to improve image sharpness and/or to tailor photographic sensitivity of the photographic elements below said interlayer.

FAST MAGENTA LAYER

In the photographic element, the most sensitive green layer or fast magenta layer may contain a magenta image dye-forming coupler, a development inhibitor releasing coupler (DIR), a timed development inhibitor releasing coupler (DIAR) and a yellow colored color correcting coupler.

The magenta image dye-forming coupler can be any magenta image dye-forming coupler useful in the photographic art as described more fully in connection with the blue sensitive layers.

A preferred magenta image dye-forming coupler for the magenta layers is represented by formula (13).

The development inhibitor releasing coupler in the fast magenta layer can be any DIR known in the photographic art as more fully described hereinafter. Typical DIR couplers are described in, for example, U.S. Pat. No. 3,227,554, the disclosure of which is incorporated herein by reference. One suitable development inhibitor releasing coupler is represented by formula (20).

Suitable timed development inhibitor releasing couplers (DIAR) useful in the invention are as described with respect to such fast yellow layer with the preferred compound being the same as described with respect to such fast yellow layer.

The color correcting coupler in the fast magenta layer can be any color correcting coupler of suitable hue for use in a photographic element. Typically this color correcting coupler is a yellow colored magenta dye-forming coupler, such as described in U.S. Pat. No. 3,519,427, the disclosure of which is incorporated herein by reference. A preferred colored correcting coupler for the fast magenta layer is represente by formula (19). This layer can also contain dyes to improve image sharpness and/or to tailor photographic sensitivity of the photographic elements below said layer.

INTERLAYER

In the photographic element the interlayer between the fast magenta layer and the fast cyan layer may contain any oxidized developer scavenger known in the photographic art. Suitable compounds useful in the invention are as described for the interlayer between the fast yellow layer and the fast magenta layer with the preferred compound being the same as described with respect to such interlayer between the fast yellow layer and the fast magenta layer. This layer can also contain dyes to improve image sharpness and/or to tailor photographic sensitivity of the photographic elements below said layer.

FAST CYAN LAYER

In the photographic element, the most sensitive red layer or fast cyan layer may contain a cyan dye-forming coupler, a development inhibitor releasing coupler (DIR), a magenta colored color correcting coupler, and a yellow image dye-forming coupler. As noted this layer may contain a cyan image dye-forming coupler or it may be a coupler starved layer containing little or no cyan image dye-forming coupler. As used herein by coupler starved is meant a condition in the layer in which there is less dye-forming coupler than is theoretically capable of reacting with all of the oxidized developing agent generated at maximum exposure. Suitable cyan dye-forming couplers may be as described for the mid cyan layer.

Coupler other than image dye-forming couplers can be present in this layer and such couplers can include, for example development inhibitor releasing couplers and color correcting couplers. These other couplers are typically used at concentrations known in the photographic art. A preferred concentration for a DIR is in the range of 0 to 35mg/m$^2$.

A development inhibitor releasing coupler (DIR) in the fast cyan layer can be any development inhibitor releasing coupler known in the photographic art as described more fully hereinafter. The DIR coupler is typically represented by the formula:

COUP—INH wherein:

COUP is a coupler moiety, and

INH is a releasable development inhibitor group that is bonded to the coupler moiety at a coupling position.

The coupler moiety, COUP, can be any coupler moiety that is capable of releasing the INH group upon oxidative coupling.

A preferred DIR coupler within COUP—INH is represented by formula (17).

The color correcting coupler in the fast cyan layer can be any color correcting coupler of suitable hue for use in a photographic element. Typically this color correcting coupler is a magenta colored cyan dye-forming coupler, such as a naphthol cyan dye-forming coupler as described in U.S. Pat. No. 3,476,536, the disclosure of which is incorporated herein by reference. A preferred color correcting coupler for the fast cyan layer is represented by formula (6).

Further, any yellow image dye-forming coupler can be used in the fast cyan layer. The yellow image dye-forming coupler is present for purposes of color correction. The yellow image dye-forming coupler in the fast cyan layer is preferably less reactive than the yellow image dye-forming coupler in the mid cyan layer. The reactivities of the yellow image dye-forming couplers should be matched with reactivities of the DIR and/or DIAR in the corresponding fast cyan and mid cyan layers. The yellow image dye-forming coupler used in the fast cyan layer can be the same as described with respect to such fast yellow layer with the preferred compound being the same as described with respect to such fast yellow layer.

MID CYAN LAYER

In the photographic element, the less sensitive red layer or mid cyan layer may contain a cyan image dye-forming coupler, a timed development inhibitor releasing coupler, a magenta colored color correcting coupler, a bleach accelerator releasing coupler, and a yellow image dye-forming coupler.

The cyan image dye-forming coupler can be any cyan image dye-forming coupler useful in the photographic art as described more fully hereinafter. One suitable cyan image dye-forming coupler for the cyan layers other than the fast cyan layer is represented by formula (5).

The DIAR which can be used can be any DIAR which will provide a timed development inhibitor release. That is, a development inhibitor releasing coupler containing at least one timing group (T) that enables timing of release of the development inhibitor group can be any development inhibitor releasing coupler containing at least one timing group known in the photographic art. The development inhibitor releasing coupler containing at least one timing group is represented by the formula:

$$\text{COUP}-\text{T}\left[\text{T}^1\right]_n\text{Q}^1$$

wherein

COUP is a coupler moiety, as described, typically a cyan, magenta, or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1;

$Q^1$ is a releasable development inhibitor group known in the photographic art. $Q^1$ can be selected from the INH group as described.

Suitable DIAR compounds are described more fully hereinafter. A preferred DIAR coupler of this type is represented by formula (14).

Suitable magenta colored color correcting couplers useful in the invention are as described for the most sensitive red layer with the preferred compound being the same as described with respect to such most sensitive red layer.

Suitable bleach accelerator releasing couplers useful in the invention are as described for the slow yellow layer with the preferred compound being the same as described with respect to such slow yellow layer.

Further, any yellow image dye-forming coupler can be used in the mid cyan layer as described for the fast cyan layer. The yellow image dye-forming coupler used in the mid cyan layer can be the same as described with respect to such slow yellow layer with the preferred compound being the same as described with respect to such slow yellow layer.

INTERLAYER

In the photographic element the interlayer between the mid cyan layer and the slow magenta layer may contain any oxidized developer scavenger and a fine grain silver halide emulsion, preferably a Lippmann emulsion, known in the photographic art. Suitable oxidized developer scavenger compounds useful in the invention are as described for the interlayer between the fast yellow layer and the fast magenta layer with the preferred compound being the same as described with respect to such interlayer between the fast yellow layer and the fast magenta layer. This layer can also contain dyes to improve image sharpness and/or to tailor photographic sensitivity of the photographic elements below said layer.

SLOW MAGENTA LAYER

In the photographic element, the least sensitive green layer or slow magenta layer may contain a magenta image dye-forming coupler and a bleach accelerator releasing coupler. Suitable magenta image dye-forming couplers useful in the invention are any of those known to be useful in the photographic art such as those described earlier for the most sensitive green layer or for use in the blue sensitive layers with one suitable compound being the same as described with respect to such most sensitive green layer.

Suitable bleach accelerator releasing couplers useful in the invention are as described for the slow yellow layer with the preferred compound being the same as described with respect to such slow yellow layer.

INTERLAYER

In the photographic element the interlayer between the slow magenta layer and the slow cyan layer may contain any oxidized developer scavenger known in the photographic art. Suitable oxidized developer scavenger compounds useful in the invention are as described for the interlayer between the fast yellow layer and the fast magenta layer with the preferred compound being the same as described with respect to such interlayer between the fast yellow layer and the fast magenta layer. This layer can also contain a dye to tailor photographic sensitivity of the photographic element below said layer.

SLOW CYAN LAYER

In the photographic element, the least sensitive red layer or slow cyan layer may contain a cyan image dye-forming coupler, a magenta colored color correcting coupler, and a bleach accelerator releasing coupler. Suitable cyan image dye-forming couplers useful in the invention are as described for the mid cyan layer with the preferred compound being the same as described with respect to such mid cyan layer.

Suitable magenta colored color correcting couplers useful in the invention are as described for the most sensitive red layer with the preferred compound being the same as described with respect to such most sensitive red layer.

Suitable bleach accelerator releasing couplers useful in the invention are as described for the slow yellow layer with the preferred compound being the same as described with respect to such slow yellow layer.

ANTIHALATION LAYER

The antihalation layer can contain very fine gray or black silver filamentary or colloidal silver, e.g. yellow silver, and preferably a UV absorbing dye, gelatin and colored dye to provide density to the film.

EMULSIONS

In the present photographic element it is desired to obtain low contrast with low granularity. This is obtained by utilizing silver halide with high iodide content. In the mid cyan and fast cyan layers the mol % silver iodide in the emulsion can range from 6 to 14 mol % iodide, and preferably 8 to 13 mol % iodide. In the remaining fast layers the silver bromoiodide in the emulsion can range from 3 to 14 mol % iodide. The slow layers contain silver bromoiodide with an iodide content of 0 to 4 mol %. The iodide concentrations in the fast layer is particularly advantageous because it enables low contrast with low granularity.

It has been found that the amount of magenta image dye-forming coupler to be coated in a layer associated with a blue sensitive layer of the photographic element of the invention should be an amount, at least 1 $mg/m^2$, sufficient to provide in a print produced from a negative element under standard exposure conditions as recommended by the manufacturer, a print having a CIELAB Metric Hue Angle (Hab) in the range of 65°–74°, preferably 67°–72°, and Metric Chroma value (Cab) in the range of 55–75, preferably 60–70, for MacBeth ColorChecker Patch No. 7 (Orange) reproductions. The MacBeth ColorChecker Color Rendition Chart is described in Leslie Stroebel et al., *Photographic Materials & Processes* (Boston, 1986), pp 541–545, which is incorporated herein by reference. The correct or standard exposure for negative film can be determined in accordance with the recommendations of the film manufacturer. In the case of Kodak Commercial Internegative film one may use the procedure recommended in Kodak Technical Data Sheet E-225T "Balancing KODAK Commercial Internegative Film" available from Eastman Kodak Company and incorporated herein by reference.

CIELAB is a system of color coordinates in which colors can be numerically specified and positioned on a CIE diagram, or map. (Ref: *Photographic Materials & Processes,* pp 492–499). On the color map, locations may be specified by the metric hue angle (measured counter-clockwise from the positive a* axis) and metric chroma (distance from the neutral center point). (Ref: Fred W. Billmeyer and Max Saltzman, *Principles of Color Technology 2Ed,* (New York, 1981) pp 62–65). Thus, a reflective print can be made from the the negative using the conventional negative/positive processing (e.g. the Kodak RA-4 process.) Then, using standard colormetric measurements and calculations, the CIELAB a* and b* values of the print can be determined for each reproduction and plotted on a CIELAB a* vs b* diagram. The measured metric hue angles and metric chroma values can then be determined in accordance with *Principles of Color Technology.* Reproduction of the MacBeth patch number 7 (orange) has been found to be a good representation of the corresponding patch in the original if the metric hue angle (hab) is between 65 and 74 degrees and preferably between 66 and 72 degrees, and if the metric chroma value (Cab) is between 55 and 75 and preferably between 60 and 70.

In one embodiment, the element contains in the fast layer amounts of image dye-forming coupler and silver halide (expressed as silver) in a weight ratio of less than 0.1 so that the layer is "extremely" starved. In even more starved arrangements, the ratio may be less than 0.05, less than 0.03, less than 0.01 and in some cases the most sensitive layer may be substantially free of image dye-forming coupler. There may also be present in the layer couplers with PUGs (which may form some dye of the desired or of another color upon coupling).

Where these other couplers are present, it is typically suitable that the combined weight ratio of the total of all the dye-forming couplers to silver in the layer is less than 0.30. Color correction couplers and those containing PUGs useful for development inhibition, masking and process sensitivity control are particularly useful.

Where the most red-sensitive layer is starved, it is important that the most and mid sensitive layers be contiguous. This permits the oxidized developer formed in the most sensitive layer to migrate to the interface with the mid layer during development and to there come into contact with image dye-forming coupler to form dye of the desired color. If the two layers are not contiguous, this result is not accomplished. The effect of this migration is to permit the oxidized developer to travel some distance from the silver halide grain where it was formed before it finds and reacts with an image dye-forming coupler. Since the fast layer requires the largest grain structure for speed, it is the layer most responsible for poor granularity.

The materials of the invention can be used in any of the ways and in any of the combinations known in the art. Typically, the invention materials are incorporated in a blue sensitive silver halide emulsion and the emulsion coated as a layer on a support to form part of a photographic element. Alternatively, the magenta image dye-forming coupler can be incorporated at a location adjacent to the blue sensitive silver halide emulsion layer where, during development, it will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements are multicolor elements which contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be -used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5 -dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl) phenoxy]acetyl]amino]-5-[(2,2,3,3,4,4,4-heptafluoro-1-oxobutyl)amino]-4-hydroxyphenoxy] -2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3 -chloro-4-((3-(2-chloro-4-((1-tridecanoylethoxy) carbonyl)anilino)-3-oxo-2-((4)(5) (6)-(phenoxycarbonyl)-1H-benzotriazol-1-yl)propanoyl)amino)) benzoate;

(3) an interlayer containing fine metallic silver;

(4) a triple-coat magenta pack with a fast magenta layer containing "Coupler 4": Benzamide, 3-((2-(2,4-bis (1,1-dimethylpropyl)phenoxy)-1-oxobutyl)amino)-N-(4,5 -dihydro-5-oxo- 1-(2,4,6-trichlorophenyl)- 1H-pyrazol-3-yl)-, "Coupler 5": Benzamide, 3-((2-(2,4-bis(1,1-dimethylpropyl)phenoxy)-1 -oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6(((3-(dodecyloxy)propyl)amino)carbonyl)-5-hydroxy-1-naphthalenyl)-, 2-methylpropyl ester , "Coupler 7": Acetic acid, ((2-((3-(((3-(dodecyloxy)propyl)amino) carbonyl)-4-hydroxy-8-(((2-methylpropoxy) carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5 -oxo-1H-pyrazol-3-yl]-2-methyl-2-propenamide; and "Coupler 10": Tetradecanamide, N-(4-chloro-3-((4-((4-((2,2-dimethyl-1-oxopropyl) amino)phenyl)azo)-4,5-dihydro-5-oxo-1(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriaz ol-2-yl)-4,6-bis(1,1-dimethylethyl)-;Phenol, 2-(2H-benzotriazol-2-yl)-4(1,1-dimethylethyl)-;Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6 -methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2- chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

( 1) one or more overcoat layers;

( 2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy- 2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol- 3-yl]-2-methyl-2-propenamide; "Coupler 4": Benzamide, 3-((2-(2,4-bis(1,1-dimethylpropyl)phenoxy)-1-oxobutyl)amino)-N- (4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy-)acetyl)amino)-N-(4,5- dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4 -heptafluoro-1-oxobutyl)amino)-3-hydroxyphenyl)-; a mid cyan containing "Coupler 7": Butanamide, N-(4-((2-(2,4-bis( 1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

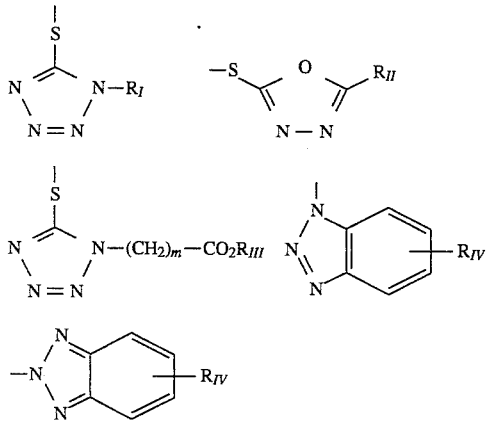

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

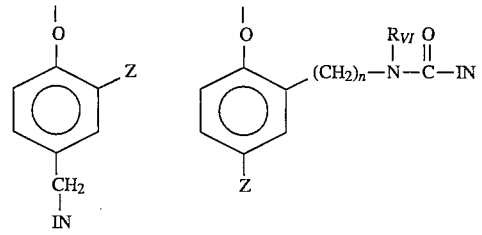

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D-1

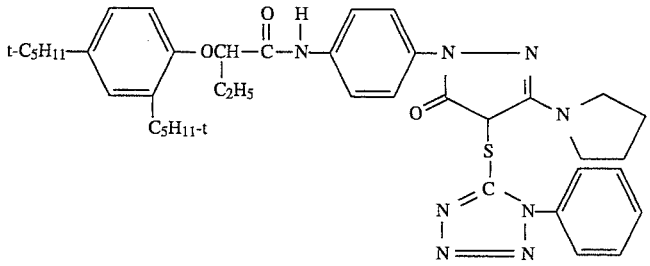

-continued
D-2
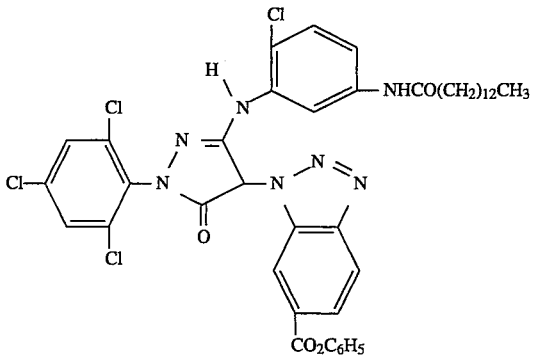
D3
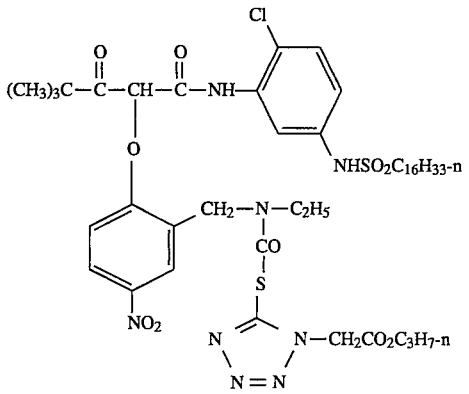
D4
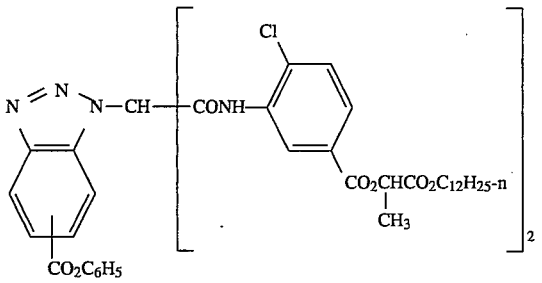
D5
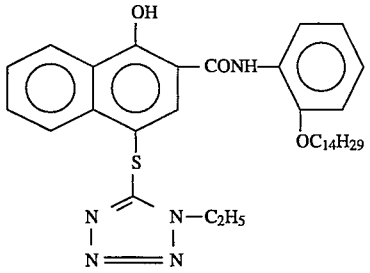
-continued
D-6
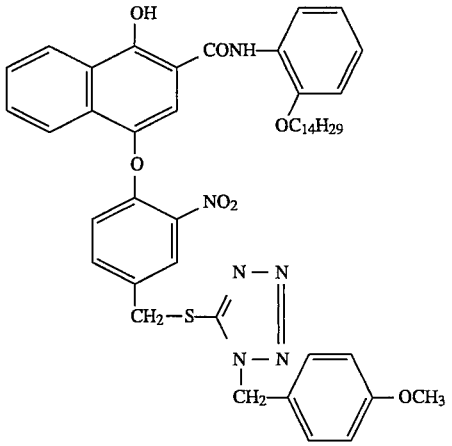
D7
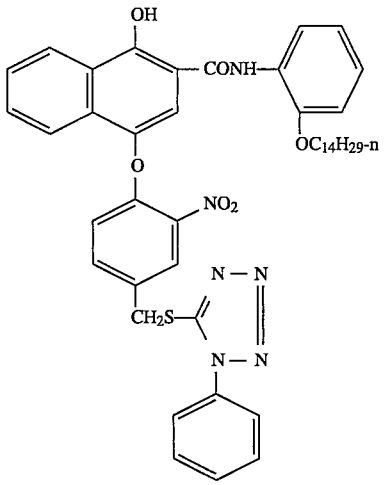

-continued

D8

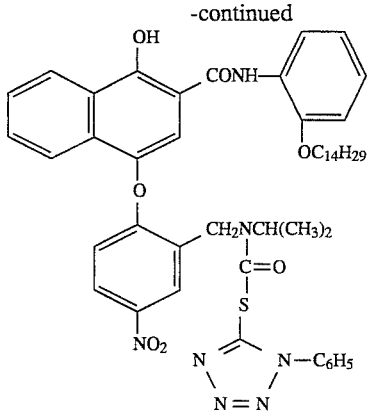

D9

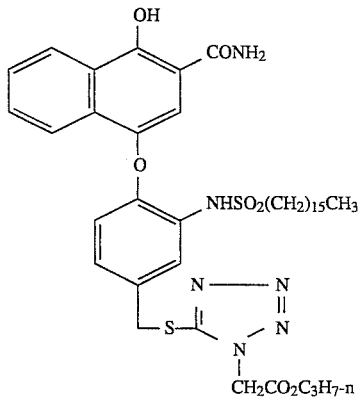

D10

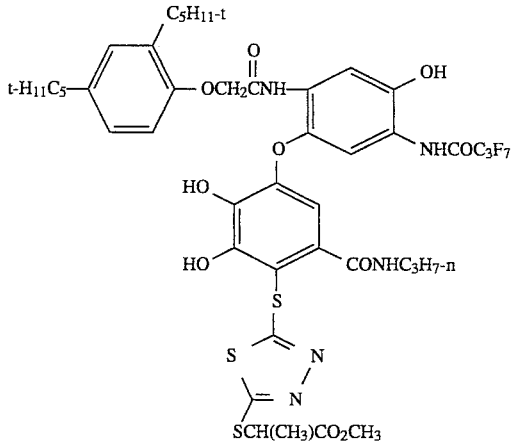

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any photographically useful substituents. Usually the further substituent will have less than 42 carbon atoms and typically less than 30 carbon atoms.

EXAMPLE 1

A three color photographic film was prepared as follows using conventional surfactants, antifoggants and the materials indicated. Film was exposed followed by processing in accordance with the Kodak C-41 process (British Journal of Photography, pp. 196–198 (1988) Excellent results, as measured by orange color reproduction, were obtained.

| Support | mg/m$^2$ | mg/ft$^2$ | |
|---|---|---|---|
| Layer 1 | | | |
| Antihalation Layer | 321.9 | 29.9 | Black filamentary silver |
| | 91.5 | 8.5 | UV absorbing dye (1) |
| | 2690. | 250.0 | Gelatin |
| Layer 2 | | | |
| Interlayer | 53.8 | 5.0 | D-Ox scavenging coupler (2) |
| | 645.6 | 60.0 | Gelatin |
| Layer 3 | | | |
| Least Sensitive Red Layer | 304.6 | 28.3 | Slow Ag Br/I emulsion containing 3.3 mole % iodide and 217 mg of sensitizing dye (3) and 91 mg of sensitizing dye (4) per mole of silver halide |
| | 370.27 | 34.4 | Cyan dye forming coupler (5) |
| | 160.9 | 1.9 | Cyan dye forming, magenta colored, masking coupler (6) |
| | 30.58 | 2.84 | Cyan dye forming development/bleach accelerator ("BARC") (7) |
| | 14.0 | 1.3 | Red filter dye (8) |
| | 1829. | 170.0 | Gelatin |
| Layer 4 | | | |
| Interlayer | 107.6 | 10.0 | D-Ox scavenging coupler (2) |
| | 32.27 | 3.0 | Preformed Yellow dye (9) |
| | 26.91 | 2.5 | Preformed Cyan dye (10) |
| | 645.6 | 60.0 | Gelatin |
| Layer 5 | | | |
| Least Sensitive Green Layer | 112.8 | 10.5 | Slow Ag Br/I emulsion containing 3.3 mole % iodide and 523 mg of sensitizing dye (11) and 151 mg of sensitizing dye (12) per mole of silver halide |
| | 338.38 | 31.4 | Slow Ag Br/I emulsion containing 3.4 mole % iodide and 859 mg of sensitizing dye (11) and 249 mg of sensitizing dye (12) per mole of silver halide |
| | 235.8 | 21.9 | Magenta dye forming coupler (13) |
| | 5.28 | 0.49 | Cyan dye forming BARC coupler (7) |
| | 48.42 | 4.5 | Red filter dye (8) |
| | 914.6 | 85.0 | Gelatin |
| Layer 6 | | | |
| Interlayer | 161.4 | 15.0 | Lippmann Ag Br emulsion |
| | 107.6 | 10.0 | D-Ox scavenging coupler (2) |
| | 645.6 | 60.0 | Gelatin |
| Layer 7 | | | |
| Mid Sensitive Red Layer | 907.59 | 84.3 | Fast Ag Br/I T-grain emulsion containing 12.27 mole % iodide and 163 mg of sensitizing dye (3) and 67 mg of sensitizing dye (4) per mole of silver halide |
| | 197.98 | 18.4 | Cyan dye forming coupler (5) |
| | 64.6 | 6.0 | Cyan dye forming development inhibitor anchimeric releasing coupler ("DIAR") (14) |
| | 64.6 | 6.0 | Yellow dye forming coupler (24) |
| | 53.8 | 5.0 | Cyan dye forming, magenta colored, masking coupler (6) |

-continued

| Support | mg/m² | mg/ft² | |
|---|---|---|---|
| | 10.76 | 1.0 | Cyan dye forming BARC coupler (7) |
| | 5.38 | 0.5 | Green filter dye (15) |
| | 1622. | 150.7 | Gelatin |
| Layer 8 | | | |
| Most Sensitive Red Layer | 333.6 | 31.0 | Fast Ag Br/I T-grain emulsion containing 8.18 mole % iodide and 188 mg of sensitizing dye (3) and 78 mg of sensitizing dye (4) per mole of silver halide |
| | 43.0 | 4.0 | Fast Ag Br/I T-grain emulsion containing 12.27 mole % iodide and 163 mg of sensitizing dye (3) and 67 mg of sensitizing dye (4) per mole of silver halide |
| | 53.87 | 5.0 | Yellow dye forming coupler (16) |
| | 21.5 | 2.0 | Cyan dye forming, magenta colored, masking coupler (6) |
| | 23.7 | 2.2 | Cyan dye forming development inhibitor releasing coupler ("DIR") (17) |
| | 538. | 50.0 | Gelatin |
| Layer 9 | | | |
| Interlayer | 107.6 | 10.0 | D-Ox scavenging coupler (2) |
| | 10.76 | 1.0 | Preformed Cyan dye (10) |
| | 645.6 | 60.0 | Gelatin |
| Layer 10 | | | |
| Most Sensitive Green Layer | 376.03 | 34.9 | Fast Ag Br/I T-grain emulsion containing 8.18 mole % iodide and 455 mg of sensitizing dye (11) and 126 mg of sensitizing dye (12) per mole of silver halide |
| | 944.61 | 87.8 | Fast Ag Br/I T-grain emulsion containing 12.27 mole % iodide and 804 mg of sensitizing dye (11) and 151 mg of sensitizing dye (12) per mole of silver halide |
| | 66.46 | 62.0 | Slow Ag Br/I emulsion containing 3.3 mole % iodide and 523 mg of sensitizing dye (11) and 151 mg of sensitizing dye (12) per mole of silver halide |
| | 586.49 | 54.48 | Magenta dye forming coupler (13) |
| | 32.3 | 3.0 | Yellow dye forming DIAR (18) |
| | 53.8 | 5.0 | Magenta dye forming, yellow colored, masking coupler (19) |
| | 26.9 | 2.5 | Magenta dye forming DIR coupler (20) |
| | 8.05 | 0.75 | Preformed Cyan dye (10) |
| | 2475. | 230.0 | Gelatin |
| Layer 11 | | | |
| Yellow Colloidal Silver Filter Layer | 107.6 | 10.0 | D-Ox scavenging coupler (2) |
| | 118.4 | 11.0 | Yellow Colloidal Silver (Carey Lee silver) |
| | 1076. | 100.0 | Gelatin |
| Layer 12 | | | |
| Most Sensitive Blue Layer | 190.06 | 17.7 | Fast Ag Br/I T-grain emulsion containing 8.18 mole % iodide and 620 mg of sensitizing dye (22) per mole of silver halide |

-continued

| Support | mg/m² | mg/ft² | |
|---|---|---|---|
| | 159.19 | 14.8 | Fast Ag Br/I T-grain emulsion containing 3.0 mole % iodide and 900 mg of sensitizing dye (22) per mole of silver halide |
| | 287.91 | 26.7 | Fast Ag Br/I T-grain emulsion containing 3.0 mole % iodide and 800 mg of sensitizing dye (22) per mole of silver halide |
| | 287.91 | 33.0 | Yellow dye forming coupler (16) |
| | 161.4 | 15.0 | Yellow dye forming DIAR (18) |
| | 53.8 | 5.0 | Magenta Dye forming coupler (13) |
| | 10.76 | 1.0 | Cyan dye forming BARC coupler (7) |
| | 32.20 | 3.0 | Preformed Yellow dye coupler (9) |
| | 43.0 | 4.0 | Blue filter dye (23) |
| | 2335. | 217.0 | Gelatin |
| Layer 13 | | | |
| Least Sensitive Blue Layer | 228.0 | 21.18 | Slow Ag Br/I emulsion containing 3.3 mole % iodide and 1254 mg of sensitizing dye (22) per mole of silver halide |
| | 564.9 | 52.5 | Yellow dye forming coupler (24) |
| | 5.38 | 0.5 | Cyan dye forming BARC coupler (7) |
| | 807. | 75.0 | Gelatin |
| Layer 14 | | | |
| UV Layer | 430.4 | 40.0 | Lippmann Ag Br emulsion |
| | 107.6 | 10.0 | UV absorbing dye (25) |
| | 37.66 | 3.5 | UV absorbing dye (1) |
| | 16.14 | 1.5 | Preformed Magenta dye coupler (27) |
| | 43.02 | 4.0 | Preformed Yellow Dye Coupler (9) |
| | 699.4 | 65.0 | Gelatin |
| | 10.76 | 1.0 | Green Filter Dye (15) |
| Layer 15 | | | |
| Protective Gelatin | 45.19 | 4.2 | First matting agent |
| | 32.28 | 3.0 | Second matting agent |
| Overcoat | 882.3 | 82.0 | Gelatin |

EXAMPLE 2 (Invention)

Film was prepared, exposed and processed in the same manner as Example 1 except that yellow image dye-forming coupler (28) was used in place of coupler (16) in layer 12, the most blue sensitive layer. Excellent reproduction of orange color was again obtained.

EXAMPLE 3 (Comparison)

Film was again prepared and processed as in Example 1 except that no magenta image dye-forming coupler was included in layer 12, and the most green sensitive layer(layer 10), was formulated as follows:

| | | | |
|---|---|---|---|
| Layer 10 | | | |
| Most Sensitive Green Layer | 376.03 | 34.9 | Fast Ag Br/I T-grain emulsion containing 8.18 mole % iodide and 455 mg of sensitizing dye (11) and 126 mg of sensitizing dye (12) per mole of silver |

-continued

| | | |
|---|---|---|
| | | halide |
| 944.61 | 87.8 | Fast Ag Br/I T-grain emulsion containing 12.27 mole % iodide and 804 mg of sensitizing dye (11) and 151 mg of sensitizing dye (12) per mole of silver halide |
| 66.46 | 62.0 | Slow Ag Br/I emulsion containing 3.3 mole % iodide and 523 mg of sensitizing dye (11) and 151 mg of sensitizing dye (12) per mole of silver halide |
| 733.11 | 68.1 | Magenta dye forming coupler (13) |
| 32.3 | 3.0 | Yellow dye forming DIAR (18) |
| 53.8 | 5.0 | Magenta dye forming, yellow colored, masking coupler (19) |
| 16.15 | 1.5 | Magenta dye forming DIR coupler (20) |
| 8.05 | 0.75 | Preformed Cyan dye (10) |
| 2475. | 230.0 | Gelatin |

Orange color reproduced form this element was too yellow to be acceptable.

EXAMPLE 4

To evaluate the color reproduction of the films of Examples 1 to 3, reproductions of MacBeth color patch No. 7 (Orange) were prepared using the film described in each of the examples. An internegative exposure was made from an Ektachrome original of a MacBeth ColorChecker Color Rendition Chart as described in *Photographic Materials & Processes* pp 541–545. The correct exposure for each film was determined using the procedure recommended in Kodak Technical Data Sheet E-225T "Balancing KODAK Commercial Internegative Film". The exact resulting exposures are listed in Table I.

TABLE I

Balanced Internegative Exposures

| | | |
|---|---|---|
| Example 1 | 40M + 35Y | 10 sec @ f/11 |
| Example 2 | 40M + 45Y | 10 sec @ f/11 |
| Example 3 | 15M + 45Y | 7 sec @ f/11 |

Internegatives were processed under the standard C-41 process conditions, and prints from the internegatives were made on Kodak Ektacolor Supra paper. Prints were color balanced to make the reproduction of the MacBeth patch number 22 (Neutral 5) appear neutral. (The aim Status A reflection densities of the patch were 0.70 c, 0.70 m, 0.70 y, with 0.01 mismatch considered acceptable.)

Using standard colormetric measurements and calculations, the CIELAB a* and b* values were determined for each reproduction and plotted on a CIELAB a* vs b* diagram. The measured metric hue angles and metric chroma values were determined in accordance with *Principles of Color Technology* The results are listed in Table II.

TABLE II

CIELAB Metric Hue Angle (Hab) and Metric Chroma (Cab) Values for MacBeth Colorchecker Patch No. 7 (Orange) Reproductions

| | Hab | Cab |
|---|---|---|
| Example 1 (Invention) | 72 deg | 62 |
| Example 2 (Invention) | 70 deg | 66 |
| Example 3 (Comparison) | 79 deg | 70 |

The metric hue angle for Example 3, 79 degrees, is outside the range of acceptance for MacBeth patch number 7 and the reproduction is therefore unacceptable. In the CIELAB coordinate system, the higher metric hue angle is interpreted as being more green than desired. As expected from the visual evaluation of Example 3, this sample gave unacceptable orange reproduction. On the other hand, acceptable orange is predicted and obtained in both Examples 1 and 2.

Formulas identified in the description and in the examples are as follows:

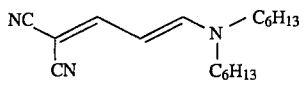

(1)

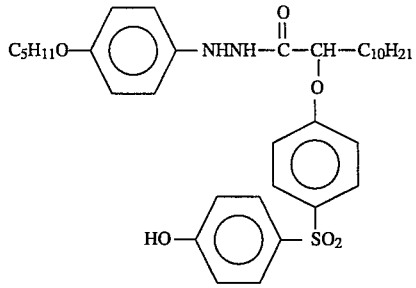

(2)

-continued
(3)
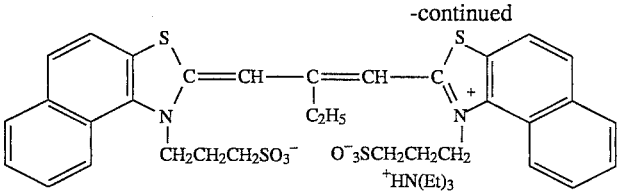
(4)
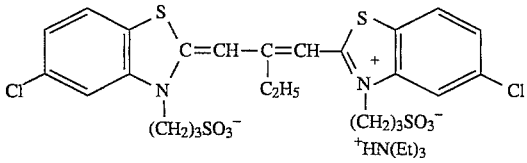
(5)
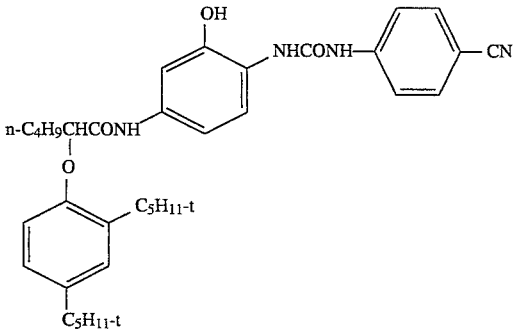
(6)
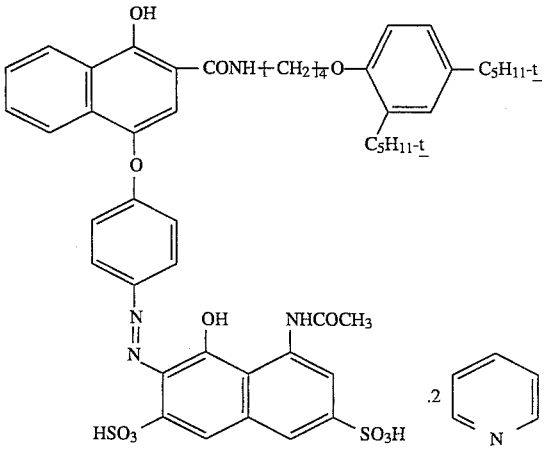
(7)
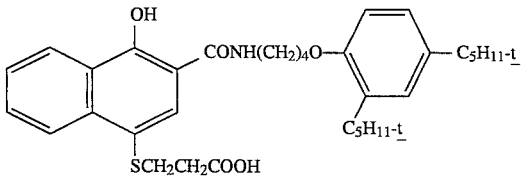
(8)
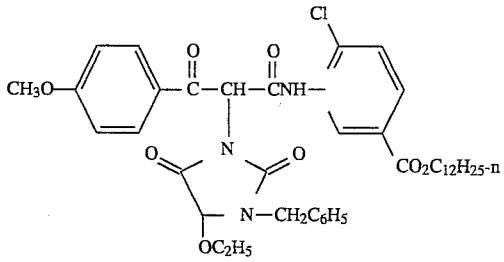

-continued
(9)
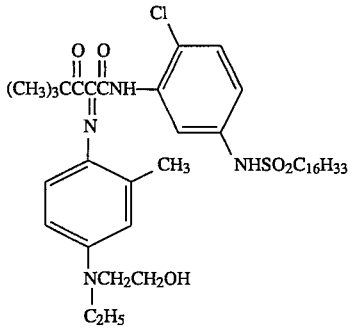
(10)
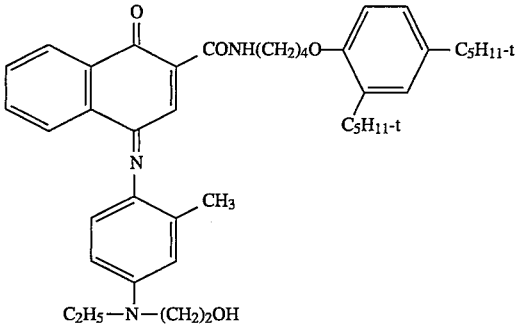
(11)
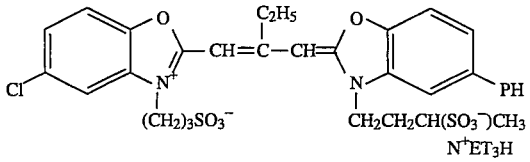
(12)
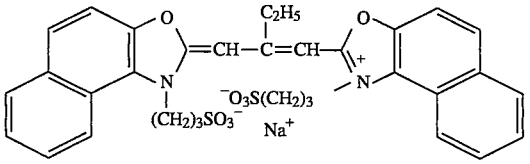
(13)
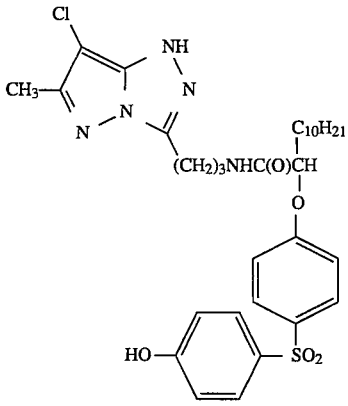

-continued
(14)
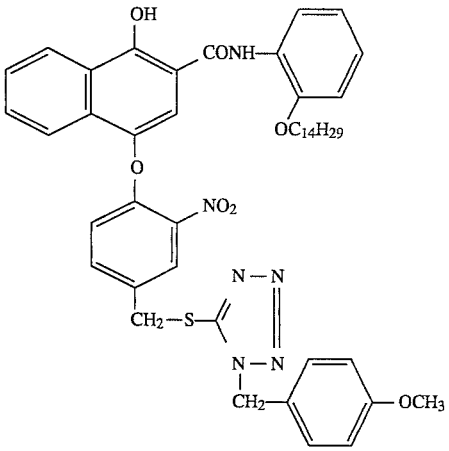
(15)
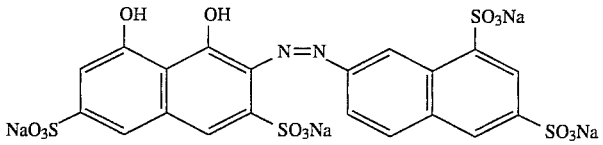
(16)
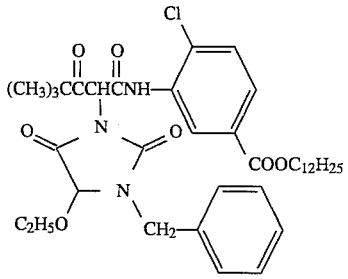
(17)
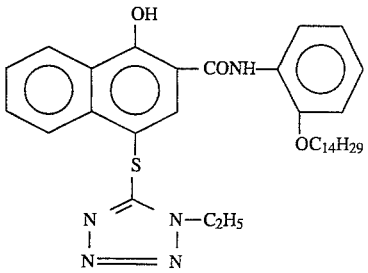
(18)
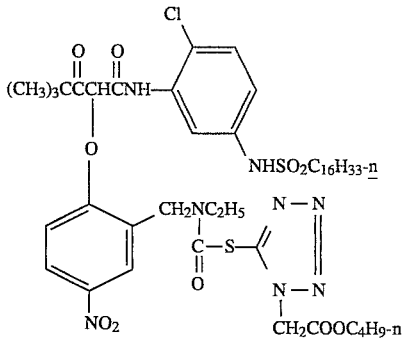

-continued
(19)
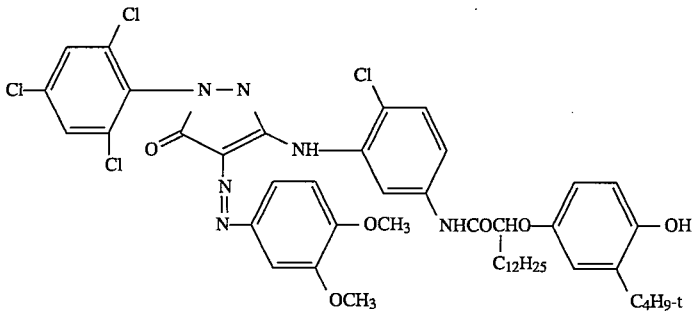
(20)
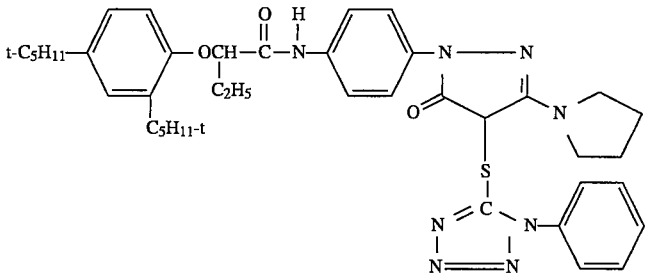
(21)
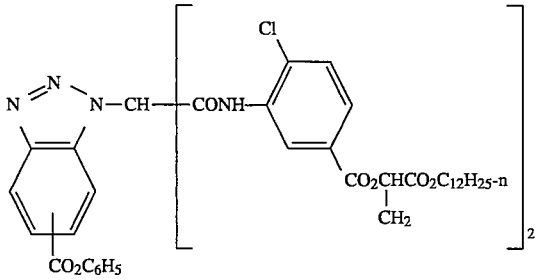
(22)
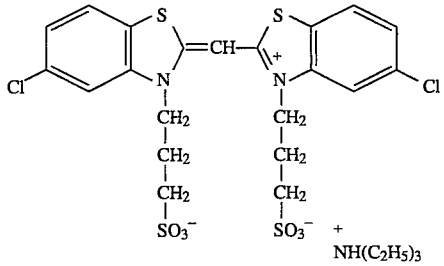
(23)
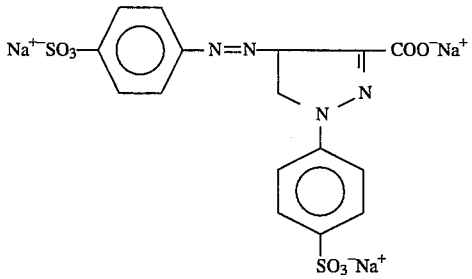

-continued (24)

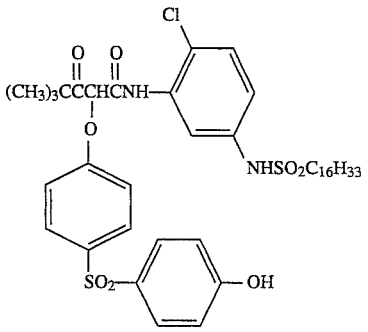

(25)

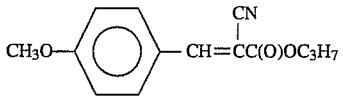

(26)

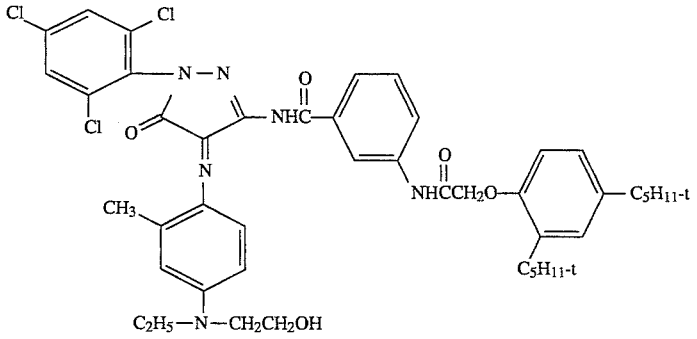

(27)

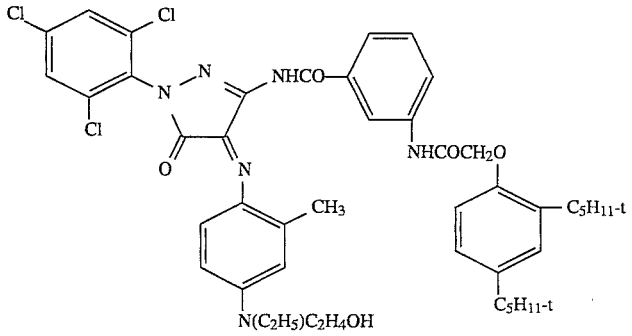

(28)

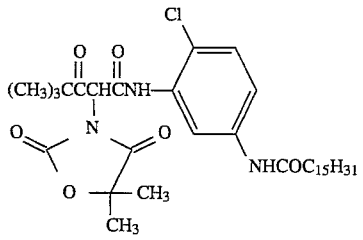

What is claimed is:

1. A multicolor photographic element comprising at least one light sensitive photographic silver halide emulsion layer sensitive to blue light and containing a yellow image dye-forming coupler, at least one light sensitive photographic silver halide emulsion layer sensitive to green light and containing emulsion layer sensitive to green light and containing a magenta image dye-forming coupler, and at least one light sensitive photographic silver halide emulsion layer sensitive to red light and containing a cyan dye-forming coupler, wherein said yellow image dye-forming coupler has the formula I:

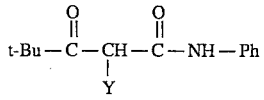

I wherein t-Bu is a tertiary butyl group, Ph is an unsubstituted phenyl ring or one containing up to 5 substituents, and Y is a heterocyclic ring, substituted or not, which is capable of leaving upon reaction of the coupler with oxidized developer; and wherein said at least one light sensitive photographic silver halide emulsion layer sensitive to blue light and containing said yellow image dye-forming coupler, or another light sensitive photographic silver halide emulsion layer sensitive to blue light and containing a yellow image dye-forming coupler, has associated therewith a magenta image dye-forming coupler, and provided that where substitution by a substituent is indicated, the substituent may, unless otherwise specified, be selected from the group consisting of halogen; nitro; hydroxyl; cyano; and carboxyl acid groups; and from alkyl; alkenyl: alkoxy; aryl; aryloxy; carbonamido; sulfonamido; sulfamoyl; carbamoyl; acyl; sulfonyl; sulfonyloxy; sulfinyl; thio; acyloxy; amino; imino; phosphate; phosphite; heterocyclic, heterocyclicoxy, and heterocyclicthio, each of which contains a 3 to 7 membered heterocyclic ring composed of carbon atoms and at least one hetero atom selected from the the group consisting of oxygen, nitrogen, and sulfur; quaternary ammonium: and silyloxy; where said substituents may themselves be further substituted with any of the above groups.

2. The element of claim 1 wherein Y contains a nitrogen atom as part of the heterocyclic ring structure.

3. The element of claim 1 wherein Y is bonded to the rest of the coupler through a nitrogen atom in the heterocyclic ring of Y.

4. The element of claim 3 wherein the heterocyclic ring contains at least 2 nitrogen atoms as ring members.

5. The element of claim 3 wherein the heterocyclic ring contains an oxygen atom as a ring member.

6. The element of claim 1 wherein the Ph group is substituted.

7. The element of claim 6 wherein the Ph group is substituted with at least one substituent selected from the group consisting of alkoxy and halogen.

8. The element of claim 1 wherein the photographic element contains at least two light sensitive photographic silver halide emulsion layers sensitive to blue light.

9. The element of claim 1 wherein Y is selected from the group consisting of substituted and unsubstituted imidazole, pyrazole, and heterocyclic compounds represented by the formula:

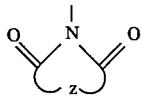

wherein z represents the atoms necessary to complete a heterocyclic ring.

10. The element of claim 7 wherein Y is represented by the formula:

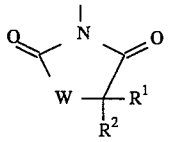

wherein W is selected from the group consisting of —O—, —S—, —N($R^3$)—, and —C($R^4$)($R^5$)—; $R^1$ is H, or substituted or unsubstituted alkyl, alkoxy, phenyl, or phenoxy; $R^2$ and $R^5$ are independently H or substituted or unsubstituted alkyl; $R^3$ is substituted or unsubstituted alkyl or phenyl; and $R^4$ is H or substituted or unsubstituted alkyl or alkoxy.

11. The element of claim 10 wherein W is —$NR^3$; $R^1$ is H, or substituted or unsubstituted alkyl or alkoxy; $R^2$ is H; and $R^3$ is substituted or unsubstituted alkyl.

12. The element of claim 11 wherein $R^1$ is —$OC_2H_5$, $R^2$ is H and $R^3$ is —$CH_2$-phenyl.

13. The element of claim 10 wherein W is —C($R^4$)($R^5$).

14. The element of claim 1 wherein Y is selected from the group consisting of:

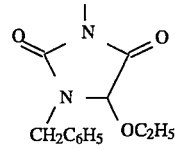

IIa

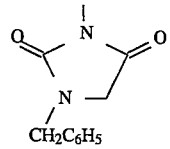

IIb

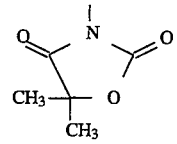

IIc

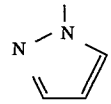

IId

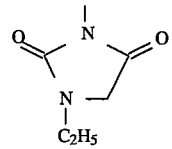

IIe

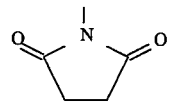

IIf

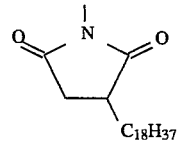

IIg

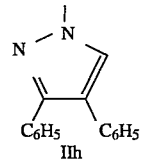

IIh

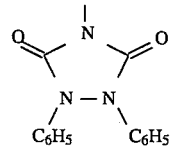

IIi

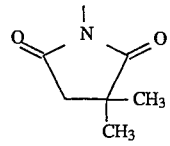

IIj

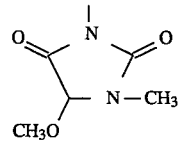

IIk

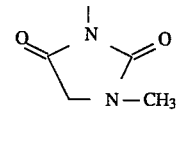

III and

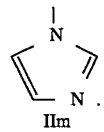

IIm.

15. The element of claim 1 wherein Y is selected from the group consisting of substituted and unsubstituted hydantoin, succinimide, imidazole and pyrazole groups.

16. The element of claim 1 wherein the Formula I coupler is selected from the group consisting of:

IA

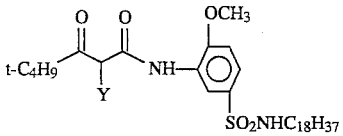

IB

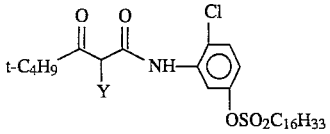

IC

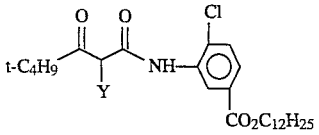

ID

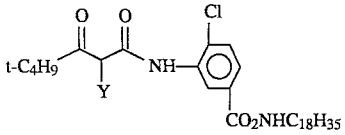

IE

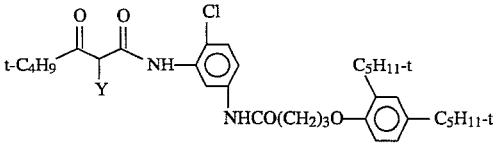

IF

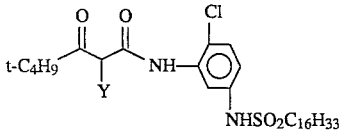

-continued

IG

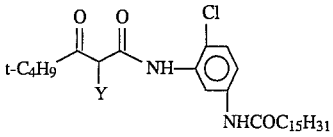

wherein Y is a coupling-off group as defined in claim 1.

17. The element of claim 1 wherein the magenta image dye-forming coupler is selected from the group consisting of the group consisting of pyrazoloazoles and pyrazolones.

18. The element of claim 1 wherein the element is a negative and the magenta image dye-forming coupler associated with said at least one light sensitive photographic silver halide layer sensitive to blue light is present in an amount, at least 1 mg/m$^2$, sufficient to provide a print having a CIELAB Metric Hue Angle (Hab) in the range of 65°–74° and Metric Chroma value (Cab) in the range of 65–75 for MacBeth ColorChecker Patch No. 7 (Orange) reproductions.

19. The element of claim 18 wherein the CIELAB metric hue angle (Hab) is in the range of 67°–72° and the metric chroma is in the range of 60–70 for MacBeth ColorChecker Patch No. 7 (Orange) reproductions.

20. A process for forming an image comprising developing an element as described in claim 1, which has been exposed to light, in the presence of a color developing agent.

* * * * *